United States Patent [19]

Heimann

[11] Patent Number: 4,842,551

[45] Date of Patent: Jun. 27, 1989

[54] MODULAR CONNECTOR ASSEMBLY FOR ELECTRICAL UTILITY BOX

[76] Inventor: Anthony J. Heimann, Willow Rd., Harvard, Mass. 01451

[21] Appl. No.: 175,663

[22] Filed: Mar. 21, 1988

Related U.S. Application Data

[63] Continuation of Ser. No. 884,498, Jul. 11, 1986, abandoned.

[51] Int. Cl.[4] ..... H01R 11/00

[52] U.S. Cl. ..... 439/502; 439/535; 439/549; 174/58

[58] Field of Search ..... 439/502, 535, 536, 549, 439/368, 538, 540, 544, 549, 552, 557, 560; 174/53, 58

[56] References Cited

U.S. PATENT DOCUMENTS

| | | | |
|---|---|---|---|
| 3,609,647 | 9/1971 | Castellano | 339/156 R |
| 3,666,886 | 5/1972 | Schneider | 339/28 |
| 4,239,320 | 12/1980 | Hesse et al. | 339/154 A |
| 4,245,880 | 1/1981 | Zimmerman et al. | 339/157 R |
| 4,335,929 | 6/1982 | Abernethy | 339/154 A |

*Primary Examiner*—David Pirlot

*Attorney, Agent, or Firm*—Weingarten, Schurgin, Gagnebin & Hayes

[57] ABSTRACT

A modular connector assembly is provided for a sheathed multiple-conductor cable and an electrical utility box. The asssembly comprises a receptacle for the exposed multiple conductors of the cable, an integral clamp to restrain the cable sheath, and means for fixing the receptacle in a punch hole in the utility box. The assembly further includes a plug having at least two electrical conductors, a flexible electrical conductor for electrically interconnecting the multiple conductors and the plug conductors, and a module which incorporates at least two spaced, conductive strips and which frictionally receives the plug. Each strip has a plurality of projecting conductors, each of which is configured to engage one of the conductors of the plug.

9 Claims, 5 Drawing Sheets

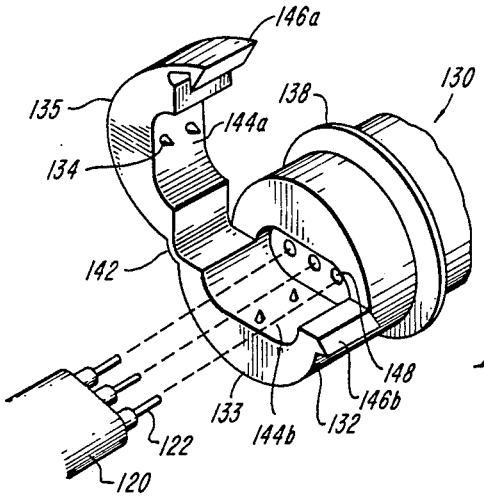
FIG. 2
FIG. 3
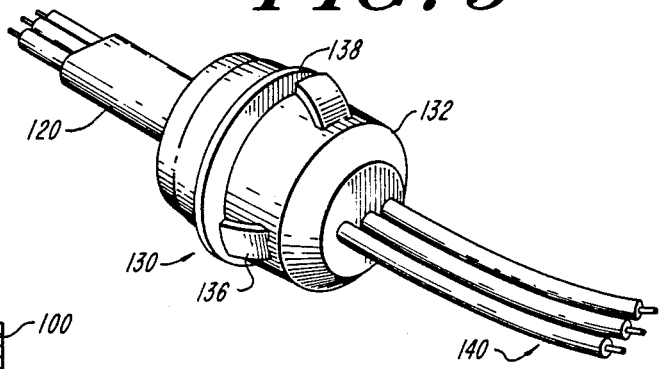
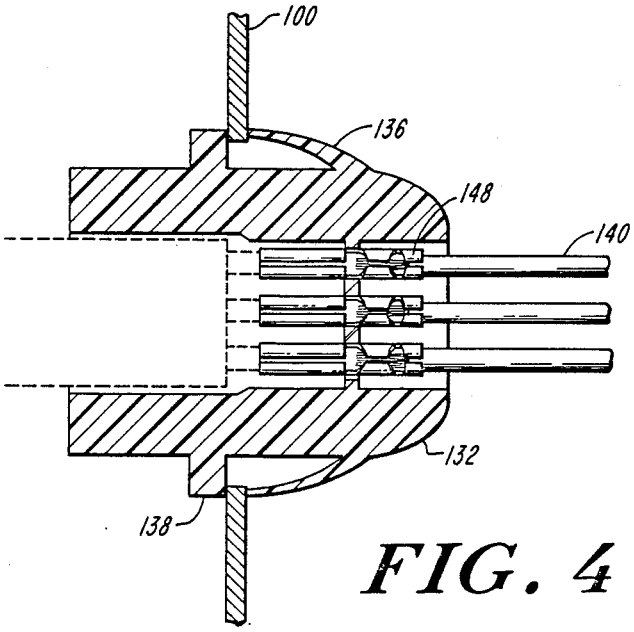
FIG. 4

MODULAR CONNECTOR ASSEMBLY FOR ELECTRICAL UTILITY BOX

This application is a continuation of application Ser. No. 884,498 filed July 11, 1986, now abandoned.

BACKGROUND OF THE INVENTION

The present invention relates generally to electrical utility boxes and specifically to electrical receptacle or switch assemblies adapted for modular connection to conventional cable.

Electrical junction boxes are commonly used in the building construction trade for the interconnection of electrical cabling and a variety of 120 VAC outlets, switches, or lamp sockets. Upon routing a sheathed, multiple-conductor cable to a junction box at a wall stud or other frame member, the disc punch-outs on the junction box are removed and the cable is inserted into and through the junction box. After connecting the switch or outlet to the cable, the assembly must be mounted within the open side of the punch-out holes. Such a process often includes the interconnection of several outlets or switches, or of cable ends received from other junction boxes, and is thus a difficult and time-consuming process due to the following problems.

The electrical cabling sheathes three metallic conductors in an insulating material. Such cabling is stiff and bulky. Switches and outlets of the prior art generally incorporate screw-type terminals for the connection of the exposed conductor ends to several conductors internal to the switch or outlet. Attachment of the cable conductors to such screw terminals must be accomplished in close proximity to the junction box and always requires the use of at least a screwdriver or similar tool. Simple wiring of junction boxes in parallel therefore requires repeated use of these screw terminals or of even more clumsy devices, such as wire nuts or electrical tape. Therefore, to connect and assemble a typical junction box is a cumbersome and tedious task. The electrician must allow ample cable to extend to the switch or outlet from the utility box for initial and future connections, yet such cabling must be confined to the interior of the junction box as the switch or outlet is closed upon the front of the junction box. Several cable ends are typically routed to one junction box and their slack portions must be coiled or nested as a bundle within the junction box after all connections are made to the requisite switch or outlet piece.

Initial assembly of a junction box occurs during a construction phase wherein large numbers of such boxes are often interconnected; therefore, junction box wiring tasks are usually repetitious and time consuming. These initial labors are usually duplicated during replacement of the switch or outlet, or during a rewiring of the junction box to accommodate new cabling or to remove old cabling.

The construction industry would therefore benefit from a junction box assembly which does not rely upon the cumbersome and typically labor-intensive screw terminal installation. Moreover, an assembly which requires neither tools, nor the nesting of bulky cabling within the junction box, would be a significant advance in construction wiring technique. Accordingly, such a junction box assembly would be rapidly and easily modified, replaced or connected to other such boxes.

SUMMARY OF THE INVENTION

The present invention includes a combined strain relief and cable conductor receptacle which is press-mounted in the typical punch-out hole of a conventional utility box. The receptacle includes several small, outwardly facing ferrule-type receptors that engage the several bared ends of a wire cable that has been routed to the box. The receptacle includes an integral clamp to restrain the cable after the wires are inserted into the ferrules. Integral to the receptacle is a short length of flexible, multi-conductor cable that terminates in a plug. The receptacle, short cable, and plug combine as one interconnector unit. The plug is keyed to any one one of several corresponding jacks located in the internally-facing side of an outlet or switch module which fills the access side of the junction box. Unlike the conventional switch or outlet, which typically require a screw terminal electrical connection, the instant switch or outlet module offers within each jack several pins to engage the corresponding conductors in the interconnect plug.

Inside the module, the jacks are interconnected in parallel by way of metallic strips between the corresponding pins of two or more jacks. Several alternative versions of the module are contemplated. In a switch module, at least one metallic strip is formed to include a cam-actuated closure between strip portions. In a plug module, pinch clips receive the blades of a typical 3-conductor utility plug.

The interconnector and the module conjoin as a press-fit assembly and further include key tabs to prevent polarity reversal during assembly. The components are easily assembled while the box is open; and the interconnector, being compact, is easily stored within the box. Modularization of the components, and standardization of their dimensions and fit, further enhances the speed and ease of junction box installation, alteration, and repair.

BRIEF DESCRIPTION OF THE DRAWINGS

FIG. 2 is a perspective view of the modular cable clamp receptacle.

FIG. 3 is a perspective view of the cable clamp receptacle of FIG. 2 in its assembled configuration.

FIG. 4 is a sectional view of the clamp receptacle of FIG. 3 as it is mounted on the utility box wall.

DETAILED DESCRIPTION OF THE INVENTION

Figure 1:
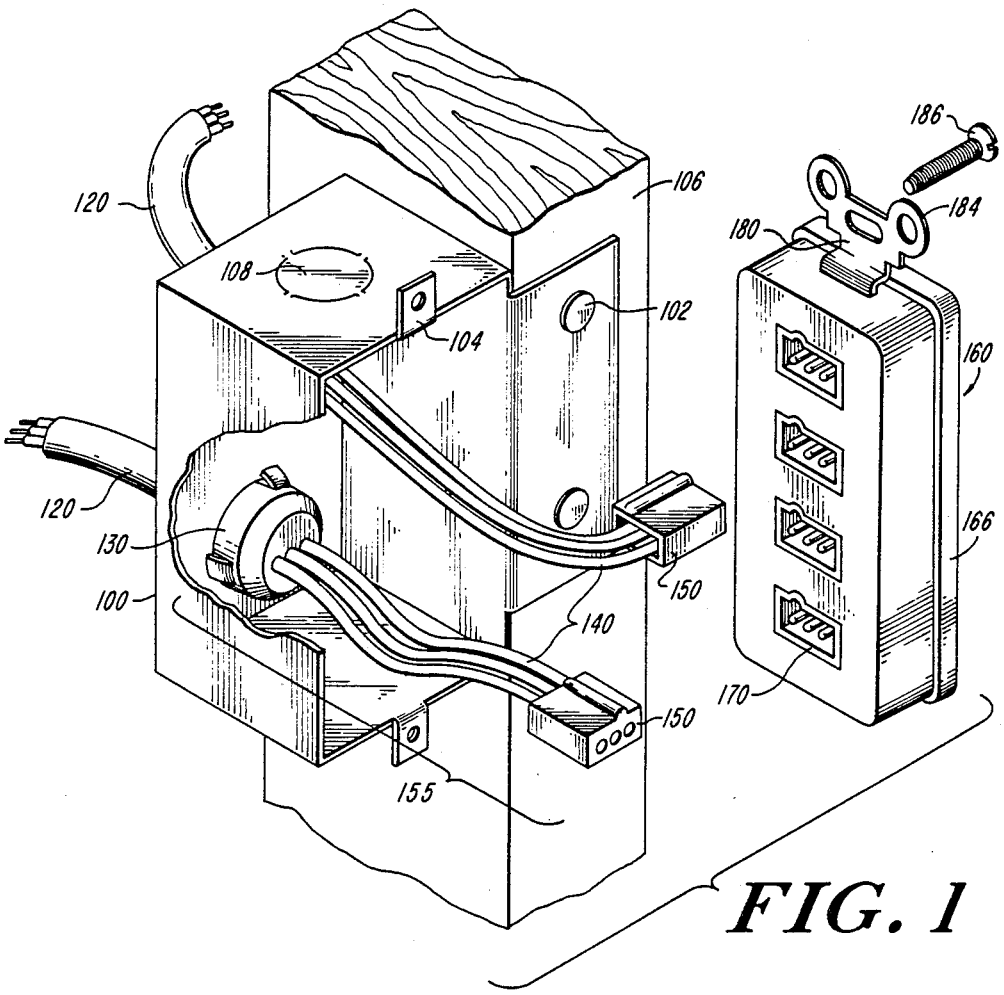
FIG. 1 is an exploded perspective view of the conventional utility box with the interconnector and switch or outlet module according to the present invention.

The components of the invention are shown in FIG. 1. A typical electrical cable 120 may be routed to the vicinity of a conventional utility box 100 and then connected to the interconnector 155, comprising a clamp receptacle 130 to which is attached an interconnect cable 140 and a interconnect plug 150. Receptacle 130, cable 140 and plug 150 perferably comprise a single interconnect 155 assembly or harness. A function module 160 includes interconnect jacks 170, a ground strip 180 having mounting ears 184, several mounting screws 186, and a front plate 166. The utility box 100 is attached as usual to a framing member 106 by way of nails 102 and receives mounting screws 186 into mounting tabs 104. The box 100 includes discs 108 which may be removed, or "punched-out", from a side of the box 100 to allow the routing of electrical cabling 120 into the box 100.

As shown in FIG. 2, after being stripped to expose a predetermined length of its several conductors 122, cabling 120 is inserted into the clamp receptacle 130. The clamp receptacle 130, interconnect cable 140, and male plug 150 are preformed as one interconnector 155 and sized so as to press into and through the utility box wall at a punch-out hole 108. Thus it is necessary only to route the usually stiff and unwielding electrical cabling 120 to the exterior of the utility box 100. The interconnect cable 140, being pliant and less bulky than the electrical cabling 120, is easily handled and is of sufficient length to allow the insertion of the interconnector plug 150 into a interconnector jack 170 while the module 160 is hand-held near the box 100. The insertion of cabling 120 into the clamp receptacle 130 and the insertion of the plug 150 into the jack 170 may be accomplished without the use of tools. Accordingly, the plug 150 remains in the jack 170 by virtue of the friction fit therebetween.

FIGS. 2 and 3 depict the several useful features of the clamp receptacle 130 which functions as an electrical and mechanical interface. The electrical cable 120, lies in a clamp well 144B of a lower body portion 133 as the exposed conductors 122 are urged into several ferrules 148 of the receptacle. Lower portion 133 of the receptacle body 132 attaches at a plastic hinge 142 to an upper portion 135 which folds under finger pressure over lower portion 133 to bring a lockig clip 146A to a locking tab 146B, thus clamping the sheathed terminus of the electrical cable 120 between portions 133 and 135. Several shallow teeth 134 in wells 144A and 144B of portions 133 and 135 grip the sheathing and thereby aid in preventing the removal of the electrical cabling from the receptacle 130. After the electrical cable 120 is clamped, the interconnector 155 is threaded through the punch-out hole. As further shown in FIG. 4, a ring 138 on the roughly cylindrical clamp body 132 and circumferential resilient snaps 136 serve to locate and fixably mount the receptacle 130 in the conventional utility box punch-out hole 108. The insertion of the receptacle 130 into the interior of the box 100 is limited by the ring 138. The receptacle 130 is held in place by snaps 136 which, having deformed during insertion of the receptacle 130, then expand to prevent the unintentional removal of the receptacle 130 from the utility box wall. The receptacle 130 can be removed from the box for any reason by momentarily compressing the snaps 136 under finger pressure and urging the clamp body 132 in a reverse motion out from the box 100.

The typical utility box 100 is sufficient to contain several interconnect cables 140, which are tucked into the utility box 100 as the function module 160 is positioned by hand and attached to the face of the box using mounting screws 186 to the tabs 104.

FIG. 4 also depicts in cross-section the construction of the clamp receptacle 130 and its position in the utility box wall. The snaps 136 are shown in their normal state and may be seen to curve against the utility box 100 opposite the ring 138. The receptacle is dimensioned in a rough equivalent to the typical diameter of the punch-out hole 108. The ring 138 overlaps the wall by a margin sufficient to counter the pressure of the snaps 136. The preferred embodiment of the receptacle 130 is molded around three conductive ferrules 148 which are pre-attached to the three flexible wires of the interconnector cable 140. Each ferrule 148 is surrounded and thereby restrained from removal by the molded fill of the receptacle 130 except for the opening of the ferrule 148 which accepts the cable conductor 122. Each ferrule 148 interior diameter is carefully dimensioned to afford a snug electrical contact between the ferrule 148 and the conductor 122. When receptacle 138 is installed in the utility box 100, the ferrules 148 are positioned so that the stripped portions of cable 120 are inside the utility box.

Figure 5:
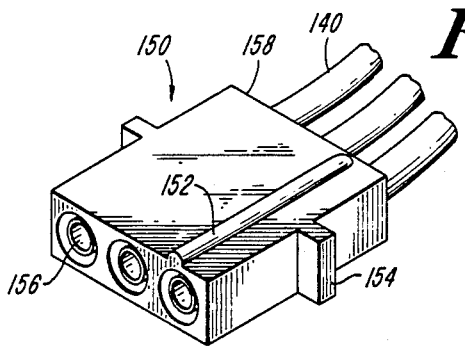
FIG. 5 is a perspective view of the plug portion of the interconnector.
Figure 6:
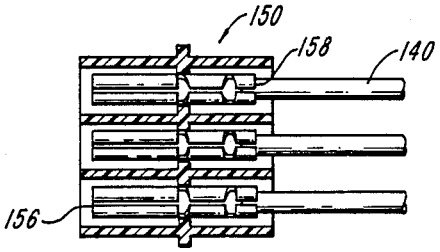
FIG. 6 is a sectional view of the plug of FIG. 5 showing its internal conductor ferrules.
Figure 7:
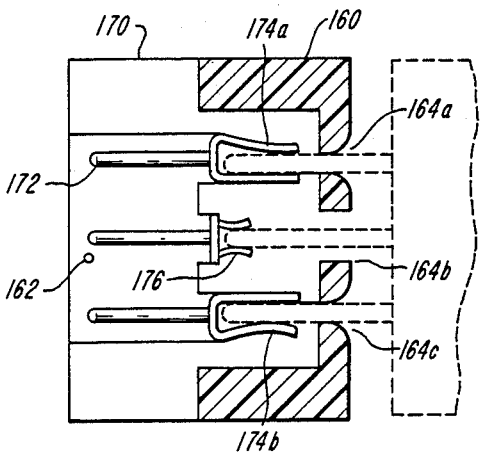
FIG. 7 is a sectional view of an outlet module and plug according to the present invention.

FIGS. 5 and 6 depict the construction of the interconnector plug 150 which, similar to the receptacle 130, terminates the three wire interconnector cable 140 in a formed body 158 molded about three plug ferrules 156. The plug 150 includes a key 152 for aligning the friction-fit insertion of the plug 150 into the interconnect jack 170 and further includes a stop 154 to limit the insertion of the plug 150 into the interconnect jack 170.

FIGS. 7–10 show the several subcomponents of the function module 160. All strip and pin subcomponents are electrical conductors. Several versions of the functional module 160 are contemplated; in one, FIGS. 7 and 8, the function module 160 is a preformed outlet receptacle which receives the blades and pin of a typical grounded electrical plug in several slots **164*a*, 164*b*, and 164*c*. Disposed within the function module 160 are two pairs of blade spring clips 174*a* and 174*b* and a central pair of pin spring clips 176 which receive the hot, common, and ground blades, respectively, of the typical electrical plug. The clips 174*a*, and 174*b*, and 176 integrally include several pins 172 which are recessed within an aperture 162. Each pin 172 is situated to enter a plug ferrule 156 as the plug 150 is inserted into the aperture 162. Electrical continuity between ferrule 156 and pin 172 is achieved by a snug fit between the bore of the ferrule 156 and the diameter of the pin 172**.

Figure 8:
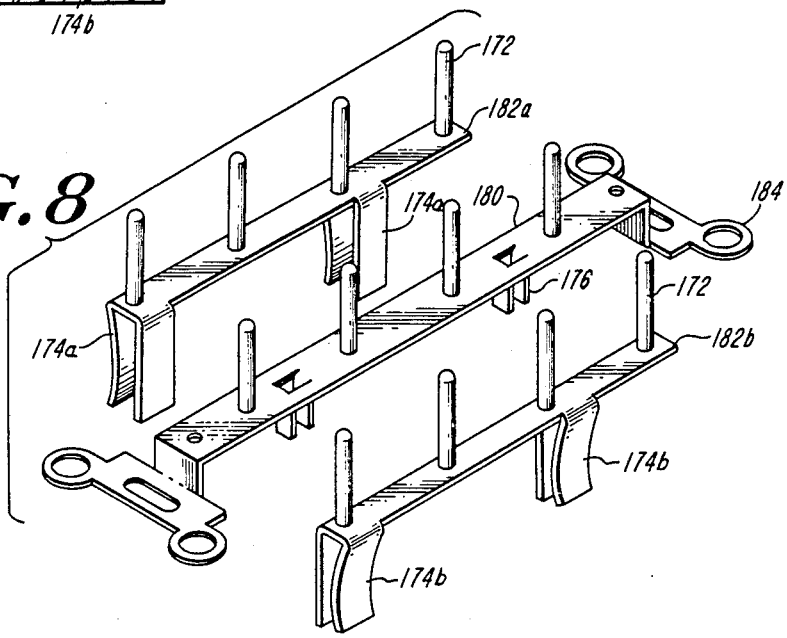
FIG. 8 is an exploded view of the internal strip and pin assembly included in the outlet module of FIG. 7.

FIG. 8 depicts the internally conducting portions of the module 160. Included are a hot strip **182*a* and a common strip 182*b* which serve to connect blade clips 174*a* and 174*b* to pins 172. A ground strip 180 includes mounting ears 184. The embodiment shown in FIG. 8 is capable of receiving the blades and pins of two typical 3-prong utility plugs. As each utility plug is inserted into the face of the function module 160, an electrical connection is made between the plug blades and pins and the respective clips 174*a*, and 174*b*, and 176**.

Figure 10:
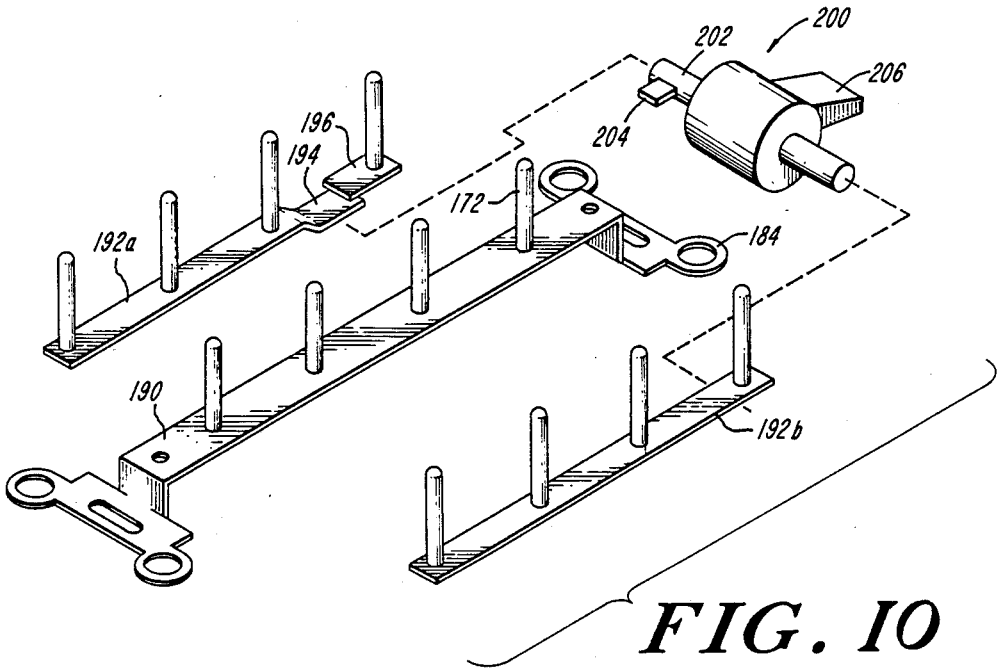
FIG. 10 is an exploded view of the pin and strip components internal to the switch module of FIG. 9.
Figure 9:
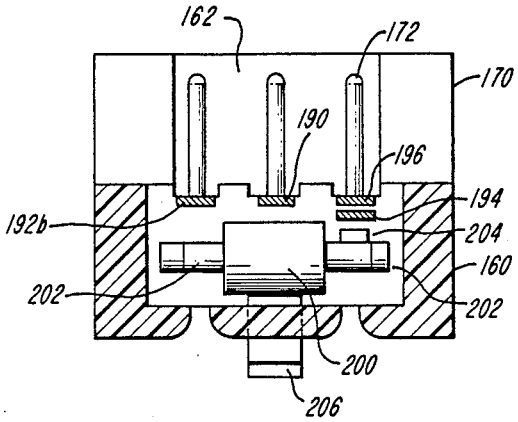
FIG. 9 is a sectional view of a switch module according to the present invention.

An alternative switch version of the functional module 160 is depicted in FIGS. 9 and 10. A switch actuator 200 comprising a barrel 202, cam 204, and lever 206 is disposed within the functional module 160 thus making it suitable for establishing and interrupting the electrical continuity between strip segments **192*a* and 196. The switch actuator 200 is pivotably mounted in the function module 160 such that rotation of the barrel 202 rotates the cam 204 to force the tab end 194 of the strip segment 192***a* against the strip segment 196. The tab 194 is formed of conductive spring metal and is normally open. Electrical continuity with the strip segment 196 occurs only when the tab 194 is forced to contact the segment 196 by the rotation of cam 204. Center strip 190 and common strip 192*b* are laterally spaced within the module 160 as in the embodiment of FIG. 8.

Another alternative module omits the blade chips 174*a*, 174*b*, and 176 of FIG. 8 to create a simple junction box module. The module can accommodate several incoming cables; because each cable is connected to its own interconnector 155, which in turn connects to the pins 172, all of the cables can be paralleled. Thus, power can be shared by all of the cables routed to the utility box 100. Of course, in the aforementioned switch and outlet embodiments, any of the pins 172 that are unused (after the initial connection of the cabling 120 that electrifies the switch version in FIG. 9 or the outlet version in FIG. 8 can receive interconnectors so as to connect additional incoming cabling in parallel with the inital incoming cable 120.

Figure 11:
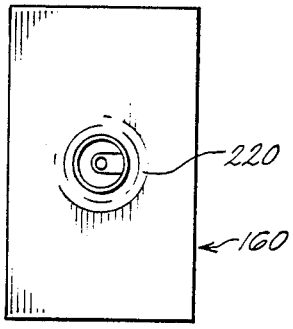
FIG. 11 illustrates a socket application.
Figure 12:
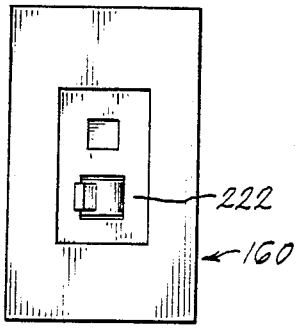
FIG. 12 illustrates a circuit breaker application.

Finally, there may be substituted a light socket 220 (FIG. 11), circuit breaker 222 (FIG. 12), or other function means for the clips 174*a*, 176b, of the module 160 for alternative uses of the utility box.

The invention is not to be limited by what has been shown and described, except as recited in the appended claims.

What is claimed is:

1. A modular connector assembly comprising a sheathed multiple-conductor cable on electrical utility box having at least one punch hole;

a preformed integral interconnector for fixably mounting the sheathed multiple-conductor cable to the electrical utility box, said preformed integral interconnector including:

a clamp receptacle for electrically and mechanically engaging exposed multiple conductors of the sheathed multiple-conductor cable, said clamp receptacle integrally including clamping means for mechanically engaging the sheath of the sheathed multiple-conductor cable to restrain the sheathed multiple-conductor cable therein, means for electrically engaging stripped conductors of the sheathed multiple-conductor cable and means for fixably mounting said clamp receptacle in the at least one punch hole of the electrical utility box.

an interconnect plug module having at least two electrical conductors fixedly associated in spaced relationship within said module, and a flexible electrical conductor having ends integrally molded in said clamp receptacle and said interconnect plug, respectively, for electrically interconnecting the stripped multiple conductors and the at least two electrical conductors of said interconnect plug; and a function module located within said utility box frictionally receiving said interconnect plug and having at least two conductive strips in spaced array, each of said at least two conductive strips having at one face a plurality of projecting conductors, and wherein each of said plurality of projecting conductors is configured to engage a corresponding one of said at least two electrical conductors of said interconnect plug.

2. A modular connector assembly comprising an electrical utility box; an electrical cable having an outer sheath and hot, common and ground leads;

a preformed integral interconnector for fixably mounting the electrical cable to the electrical utility box, said preformed integral interconnector including a clamp receptacle for electrically and mechanically engaging the electrical cable having leads for hot, common, and ground functions, said clamp receptacle having integral clamping means for mechanically securing the outer sheath of the electrical cable to within said clamp receptacle and a plurality of conductive ferrules, each of said plurality of conductive ferrules electrically engageing corresponding stripped ends of the hot, common and ground leads, an interconnector cable having a plurality of conductors each of which is integral with said clamp receptacle and is connected to a corresponding one of said plurality of conductive ferrules, and an integral interconnect plug terminating said plurality of interconnector cable conductors in a corresponding plurality of exposed electrical conductors; and a function module located within said utility box having a plurality of internally mounted conductive strips each of which correspond to one of said plurality of exposed electrical conductors, each of said plurality of internally mounted conductive strips including at least one receptor which accepts a corresponding one of said plurality of exposed electrical conductors of said interconnect plug and said function module having a housing frictionally receiving said interconnect plug and fixable to the utility box.

3. The assembly of claim 2 wherein said function module further includes a switch lever and wherein one of said plurality of internally mounted conductive strips is segmented to include a resilient portion for electrical engagement between segments of said one of said plurality of internally mounted conductive strips upon actuation of said switch lever.

4. The assembly of claim 2 wherein each of said plurality of internally mouted conductive strips includes at least one spaced spring clip pair for engagement of a blade electrical conductor.

5. The assembly of claim 2 wherein said function module includes a light socket.

6. The assembly of claim 2 wherein said function module includes a circuit breaker.

7. Modular electrical connector assembly comprising a utility box; a cable having an outer sheath and stripped multiple conductors;

a preformed integral interconnector for fixably mounting the cable to the utility box, said preformed integral interconnector including a clamp receptacle for electrically engaging each of the stripped multiple conductors of the cable and for mechanically engageing the outer sheath of the cable, an interconnect plug having a plurality of exposed conductors, and a flexible interconnect cable having ends integrally disposed within said clamp receptacle and said interconnect plug, respectively, for maintaining electrical continuity between said clamp receptacle and said plurality of exposed conductors; and a function module located within said utility box press-fit receiving said interconnect plug including integrally a plurality of conductive strips each of which include projecting conductors of shape complementary to said plurality of exposed conductors to electrically engage corresponding ones of said plurality of exposed conductors.

8. Modular electrical connector assembly comprising a utility box; a cable having an outer sheath and stripped multiple conductors;

a preformed integral interconnector for fixably mounting the cable to the utility box, said preformed integral interconnector including a clamp receptacle having integral means for electrically engaging each of the stripped multiple conductors of the cable and integral means for mechanically engaging the outer sheath of the cable, an interconnect plug having a plurality of exposed conductors, and a flexible interconnect cable having ends integrally formed with said clamp receptacle and said interconnect plug, respectively, for maintaining electrical continuity between said clamp receptacle and said plurality of exposed conductors; and a function module located within the utility box press-fit receiving said interconnect plug including integrally a plurality of conductive strips each of which include projecting conductors of shape complementary to said plurality of exposed conductors to electrically engage corresponding ones of said plurality of exposed conductors and wherein one of said plurality of conductive strips includes switch closable segments to selectively interrupt the electrical continuity therebetween.

9. Modular electrical connector assembly for use in combination with a utility box; a cable having an outer sheath and stripped multiple conductors;

a preformed integral interconnector for fixably mounting the cable to the utility box, said preformed integral interconnector including a clamp receptacle having integral means for electrically engaging each of the stripped multiple conductors of the cable and integral means for mechanically engaging the outer sheath of the cable, an interconnect plug having a plurality of exposed conductors, and a flexible interconnect cable having ends integrally formed with said clamp receptacle and said interconnect plug for maintaining electrical continuity between said clamp receptacle and said plurality of exposed conductors; and a module located within said utility box press-fit receiving said interconnect plug including integrally a plurality of conductive strips each of which include projecting conductors of shape complementary to said plurality of exposed conductors to electrically engage corresponding ones of said plurality of exposed conductors and further including a light socket internally connected to said plurality of conductive strips.

* * * * *

UNITED STATES PATENT AND TRADEMARK OFFICE

CERTIFICATE OF CORRECTION

PATENT NO. : 4,842,551

DATED : June 27, 1989

INVENTOR(S) : Anthony J. Heimann

It is certified that error appears in the above-identified patent and that said Letters Patent is hereby corrected as shown below:

In Column 3, line 23, "unwielding" should read --unwieldly--.

In Column 3, line 44, "lockig clip" should read --locking clip--.

In Column 4, line 20, "receptacle 138" should read --receptacle 130--.

In Column 4, line 34-35, "func-tional module" should read --func-tion module--.

In Column 5, line 19, "FIG. 8 can" should read --FIG.8) can--.

In Column 5, line 24, "clips 174a, 176b, of" should read --clips 174a, 174b, 176 of--.

In Column 5, line 31, "cable on" should read --cable; an--.

In Column 6, line 10, "cable to within" should read --cable within--.

In Column 6, line 42, "mouted" should read --mounted--.

UNITED STATES PATENT AND TRADEMARK OFFICE

CERTIFICATE OF CORRECTION

PATENT NO. : 4,842,551

DATED : June 27, 1989

INVENTOR(S) : Anthony J. Heimann

It is certified that error appears in the above-identified patent and that said Letters Patent is hereby corrected as shown below:

In Column 8, line 3-4, "for use in combination with a" should read --comprising a--.

Signed and Sealed this

Eighth Day of September, 1992

*Attest:*

*Attesting Officer*

DOUGLAS B. COMER

*Acting Commissioner of Patents and Trademarks*